US008278827B2

(12) United States Patent
Ku et al.

(10) Patent No.: US 8,278,827 B2
(45) Date of Patent: Oct. 2, 2012

(54) LED LAMP

(75) Inventors: Chin-Long Ku, Taipei Hsien (TW); Ju Li, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 336 days.

(21) Appl. No.: 12/750,682

(22) Filed: Mar. 30, 2010

(65) Prior Publication Data

US 2011/0115390 A1 May 19, 2011

(30) Foreign Application Priority Data

Nov. 19, 2009 (CN) ..... 2009 1 0309989

(51) Int. Cl.
*H05B 37/00* (2006.01)

(52) U.S. Cl. ..... 315/127; 315/122; 315/185 R

(58) Field of Classification Search ..... 315/185 R, 315/193, 314, 122, 127; 362/227, 362, 800, 362/217.12–217.17, 249.02
See application file for complete search history.

(56) References Cited

U.S. PATENT DOCUMENTS

| | | | | |
|---|---|---|---|---|
| 7,550,935 | B2 * | 6/2009 | Lys et al. | 315/318 |
| 2002/0048169 | A1 * | 4/2002 | Dowling et al. | 362/234 |
| 2003/0151917 | A1 * | 8/2003 | Daughtry et al. | 362/231 |
| 2005/0174780 | A1 * | 8/2005 | Park | 362/294 |
| 2010/0290220 | A1 * | 11/2010 | McDermott | 362/231 |

* cited by examiner

*Primary Examiner* — Jacob Y Choi
*Assistant Examiner* — Henry Luong
(74) *Attorney, Agent, or Firm* — Altis Law Group, Inc.

(57) ABSTRACT

An exemplary light emitting diode (LED) lamp includes a lamp body, an LED module and a switching member. The LED module is mounted on the lamp body and includes a plurality of first LED components emitting a first light with a first color temperature and a plurality of second LED components emitting a second light with a second color temperature. The switching member is mounted around the lamp body and can be operated to cause the LED lamp to work in different modes. In the different modes, different numbers of the first and second LED components are driven to emit light with different color temperatures.

7 Claims, 2 Drawing Sheets

LED LAMP

BACKGROUND

1. Technical Field

The present disclosure relates to light emitting diode (LED) lamps, and particularly to an LED lamp with an adjustable color temperature.

2. Description of Related Art

A conventional LED lamp generally includes a lamp body and a plurality of LEDs attached to the lamp body. Light emitted by the LEDs has a constant color temperature. So the conventional LED lamp cannot satisfy a requirement that a color temperature of the LED lamp is variable, which may be required for some applications.

What is needed, therefore, is an LED lamp which has an adjustable color temperature to satisfy different requirements.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
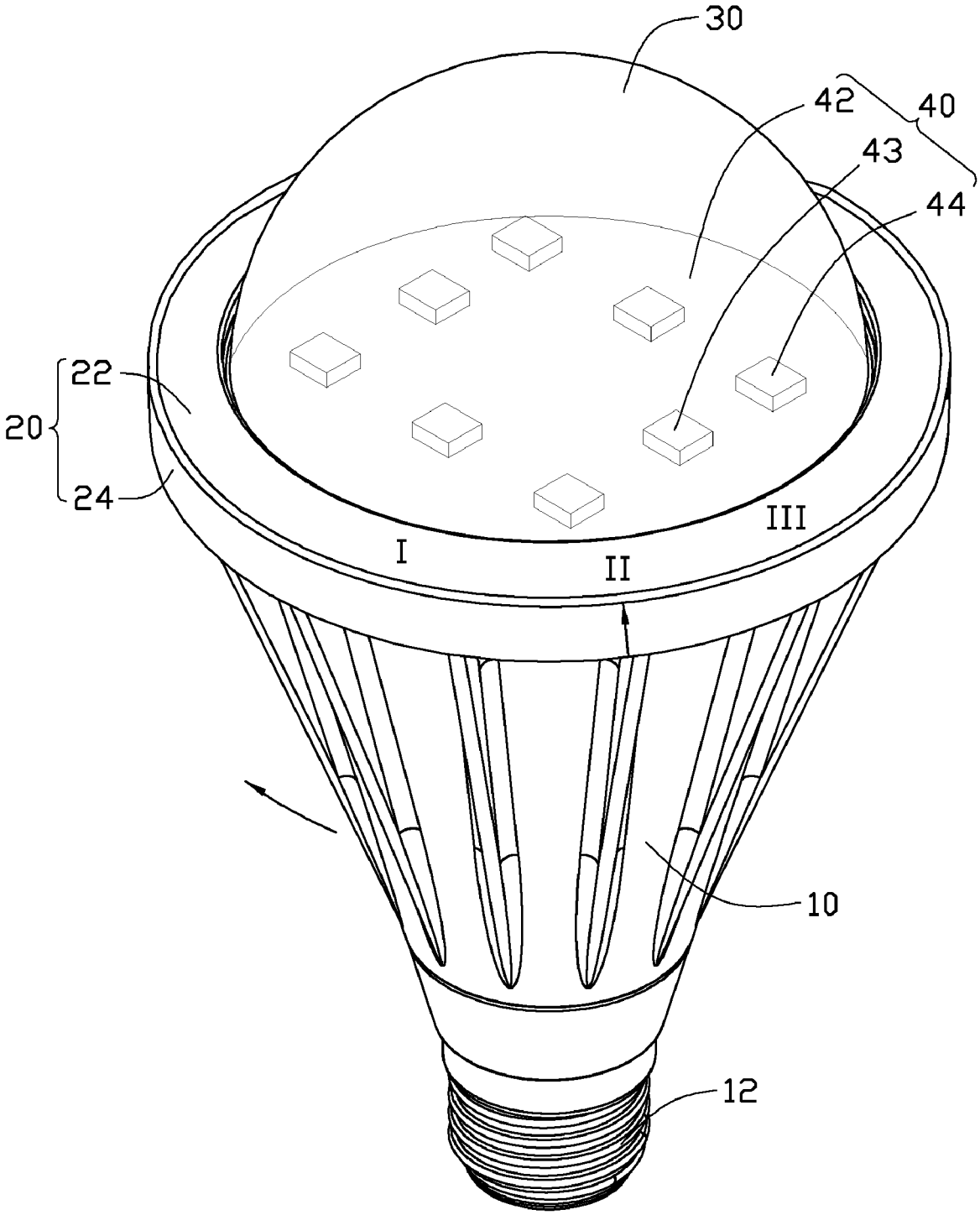
FIG. 1 is an assembled view of an LED lamp in accordance with an embodiment of the present disclosure.

Referring to FIG. 1, an LED lamp in accordance with an embodiment is illustrated. The LED lamp is configured for being held indoors or outdoors to provide illumination in different color temperatures. The LED lamp comprises a lamp body 10, a switching member 20 mounted on a periphery of a top the lamp body 10, an LED module 40 mounted on a central portion of the top of the lamp body 10 and a cover 30 secured on the lamp body 10 and covering the LED module 40.

The lamp body 10 has a shape of a cone in this embodiment; though, the lamp body 10 is not restricted to this shape and can have other shape such as a cylinder in another embodiment. A lamp holder 12 is connected to a small end of the lamp body 10, which is located at a bottom of the lamp body 10. The lamp holder 12 is configured for coupling the LED lamp to a lamp base (not shown) or socket (not shown) to supply electric power to the LED lamp.

The lamp cover 30 is a convex, transparent sheet and fixed on the top of the lamp body 10.

The LED module 40 comprises a printed circuit board 42 and a plurality of first LED components 43 and second LED components 44 mounted on the printed circuit board 42. The printed circuit board 42 is a circular plate, snugly mounted on the top of the lamp body 10 and wholly covered within the lamp cover 30. The top of the lamp body 10 is larger than the bottom of the lamp body 10. The first and second LED components 43, 44 are mounted on a top side of the printed circuit board 42 and face to the lamp cover 30. Light emitted by the first and second LED components 43, 44 can all directly travel through the lamp cover 30 to illuminate an outside. The first LED components 43 only emit a first light with a first color temperature. The second LED components 44 only emit a second light with a second color temperature. A number of the first LED components 43 is equal to that of the second LED components 44. In this embodiment, both the numbers of the first LED components 43 and the second LED components 44 are four.

Figure 2:
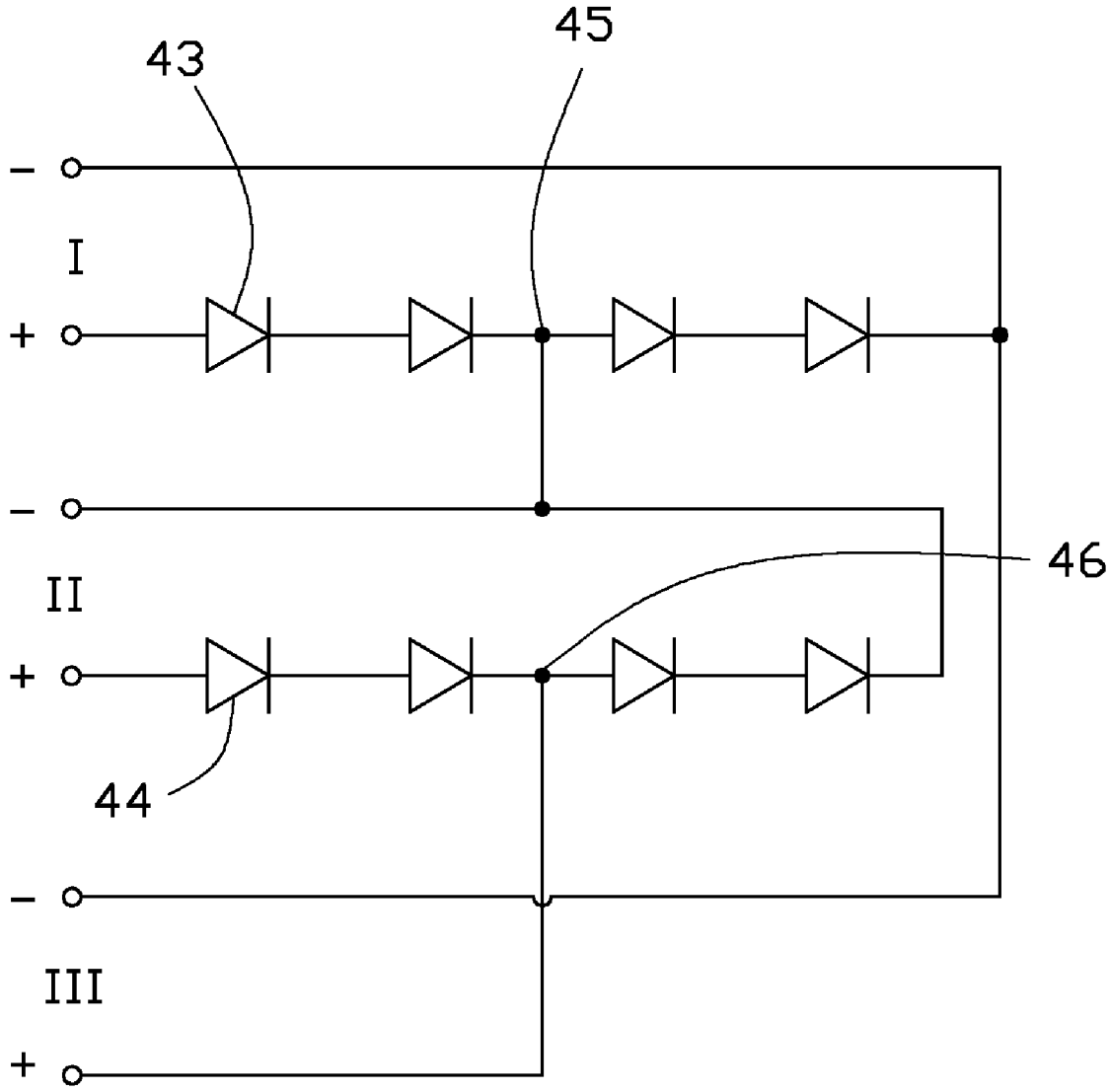
FIG. 2 is an illustrative view of a circuit diagram of the LED lamp of FIG. 1.

FIG. 2 shows a block diagram of the LED lamp. The first LED components 43 are connected in series, and the second LED components 44 are connected in series. An anode (not labeled) of one outmost first LED component 43 is adopted for connecting a positive pole (not labeled) of a power source (not shown), and a cathode of the other outmost first LED component 43 is adopted for connecting a negative pole (not labeled) of the power source. Similarly, an anode (not labeled) of one outmost second LED component 44 is adopted for connecting the positive pole of the power source, and a cathode (not labeled) of the other outmost second LED component 44 is adopted for connecting the negative pole of the power source. In addition, a first node 45 is formed at a middle of the first LED components 43 and connects to the cathode of the other outmost second LED component 44. A second node 46 is formed at a middle of the second LED components 44 for connecting the positive pole of the power source.

Referring to FIG. 1 again, the switching member 20 is mounted around the top of the lamp body 10, and comprises an annular fixing part 22 and an annular operating part 24 rotatably mounted around the fixing part 22. The fixing part 22 is fixed on the periphery of the top of the lamp body 10 and extends outwardly and horizontally therefrom. Three labels I, II, III are formed on the fixing part 22. A portion of the fixing part 22 corresponding to each of the labels I, II, III forms an electrode. More specifically, the electrode corresponding to label I is electrically coupled to the anode of the one outmost first LED component 43, the electrode corresponding to label II is electrically coupled to the anode of the one outmost second LED component 44, and the electrode corresponding to label III is electrically coupled to second node 46.

The operating part 24 is arranged around the fixing part 22 and rotatable relative to the fixing part 22 to adjust color temperatures of the LED lamp. An arrow is formed on the operating part 24. A portion of the operating part 24 corresponding to the arrow functions as an electrode for contacting one of the electrodes of the fixing part 22. When the LED lamp is in use, the electrode of the operating portion 24 is connected to the positive pole of the power source.

Also referring to FIG. 2, the LED lamp can be selected to work in different modes, by rotating the operating part 24 of the switching member 20 to make the arrow labeled on the operating part 24 aim at one of the labels "I", "II" and "III" (shown in FIG. 1). Corresponding to different working modes, the first and second LED components 43, 44 on work are different. For example, when the arrow of the operating part 24 is turned to aim at the label "I" of the fixing part 22, the positive pole of the power source is connected to point I (shown in FIG. 2) to make all of the first LED components 43 in a closed loop of the circuit, and all of the second LED components 44 in an open loop of the circuit. That is, when the arrow of the operating part 24 turned to I, all of first LED components 43 are lighted and emit the first light with the first color temperature, and all of the second LED components 44 are off. When arrow is turned to aim at the label "II", the positive pole of the power source is connected to point II (shown in FIG. 2) to make all of the second LED components 44 in a closed loop of the circuit and emit the second light with the second color temperature. In this state, the first LED components 43 are in an open loop of the circuit and off. When arrow is turned to aim at "III", the positive pole of the power source is connected to point III (shown in FIG. 2) to make two of the first LED components 43 and two of the second LED components 44 are in a closed loop of the circuit and emit light, and the other first and second LED components 43, 44 in an open loop and off.

In other embodiment, each of the first LED components 43 and the second LED components 44 may be emit different light with different color temperatures and the number of the first and second LED components 43, 44 may be varied according to different requirements and situations.

In use of the LED lamp, the LED lamp can be easily adjusted to provide illumination light in different color temperatures to satisfy different requirements in practice, by only simply rotating the operating part 24 of the switching member 20 thereof.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light emitting diode (LED) lamp, comprising:

a lamp body;

an LED module mounted on the lamp body, the LED module comprising a first LED unit emitting a first light with a first color temperature and a second LED unit emitting a second light with a second color temperature different from the first color temperature; and a switching member comprising a fixing part fixed on the lamp body and a rotating part rotatably mounted around the fixing part, a plurality of electrodes being formed on a fixing member respectively connecting different points of the first and second LED units, and a rotating member forming an electrode contacting one of the electrodes of the fixing part when the LED lamp is in use, a connection of the electrode of the rotating member and the electrodes of the fixing number causing the first and second LED units to emit light in a plurality of working modes having color temperatures different from each other;

wherein the first LED unit comprises a plurality of first LED components connected in series, and the second LED unit comprises a plurality of second LED components connected in series, an anode of the first LED unit and an anode of the second LED unit being connected to different electrodes of the fixing part; and wherein a middle of the first LED unit is connected to a cathode of the second LED unit, and a middle of the second LED unit is connected to another one of the electrodes of the fixing part.

2. The LED lamp of claim 1, wherein the electrode of the rotating part is adapted for connecting a positive pole of an electric power.

3. The LED lamp of claim 1, further comprising a cover shielding the LED module.

4. The LED lamp as claimed in claim 1, wherein either the fixing part or the rotating part is annular and mounted around the lamp body.

5. The LED lamp as claimed in claim 1, wherein the fixing part extends outwardly and horizontally from an edge of a top of the lamp body, and the rotating part is rotatable relative to the fixing part.

6. The LED lamp as claimed in claim 1, wherein the lamp body has a shape of a cone, a top of the lamp body is larger than a bottom of the lamp body, the switching member being mounted around the top of the lamp body.

7. The LED lamp as claimed in claim 6, wherein the LED module further comprises a printed circuit board (PCB) snugly mounted on the top of the lamp body, and the first and second LED components are mounted on the PCB.

* * * * *